US006396442B1

(12) United States Patent
Kawahata et al.

(10) Patent No.: US 6,396,442 B1
(45) Date of Patent: May 28, 2002

(54) CIRCULARLY POLARIZED ANTENNA DEVICE AND RADIO COMMUNICATION APPARATUS USING THE SAME

(75) Inventors: Kazunari Kawahata, Machida; Shigekazu Ito; Atsuyuki Yuasa, both of Sagamihara; Hisashi Akiyama, Yokohama, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/833,960

(22) Filed: Apr. 12, 2001

(30) Foreign Application Priority Data

Apr. 13, 2000 (JP) ..... 2000-111818

(51) Int. Cl.[7] ..... H01Q 1/38
(52) U.S. Cl. ..... 343/700 MS; 343/702
(58) Field of Search ..... 343/700 MS, 702, 343/846, 848, 850, 873; H01Q 1/38, 1/24

(56) References Cited

U.S. PATENT DOCUMENTS 5,210,542 A * 5/1993 Pett et al. ..... 343/700 MS
6,281,848 B1 * 8/2001 Nagumo et al. ..... 343/700 MS
6,314,275 B1 * 11/2001 Pedersen et al. ..... 343/700 MS

* cited by examiner

*Primary Examiner*—Hoanganh Le
(74) *Attorney, Agent, or Firm*—Ostrolenk, Faber, Gerb & Soffen, LLP

(57) ABSTRACT

A circularly polarized antenna device in which a recess is formed in the bottom surface of a dielectric base, and in which a feeder circuit is formed on an area of the top surface of a feeder circuit board covered by the recess. A shield for the feeder circuit is provided inside the recess. A feeder electrode is formed on an outer peripheral side surface of the dielectric base so as to be separated from a radiation electrode. A feeder wiring pattern which connects the feeder circuit and the feeder electrode so that they are in electrical conduction is formed on the top surface of the feeder circuit board. Electrical power supplied to the feeder electrode from the feeder circuit through the feeder wiring pattern is transmitted to the radiation electrode by capacitive coupling. Since the feeder circuit and the shield are accommodated inside the recess of the dielectric base, it is possible to restrict the bulkiness of the circularly polarized antenna device, and, thus, to make it thin. The invention aims at making the circularly polarized antenna device thinner.

16 Claims, 8 Drawing Sheets

CIRCULARLY POLARIZED ANTENNA DEVICE AND RADIO COMMUNICATION APPARATUS USING THE SAME

BACKGROUND OF THE INVENTION

1. Field of the Invention

The present invention relates to a circularly polarized antenna device for transmitting and receiving circularly polarized electric waves.

2. Description of the Related Art

FIG. 9 is a perspective view of an example of a circularly polarized antenna device. A circularly polarized antenna device 30 is used, for example, in DAB (digital audio broadcast) systems in order to transmit and receive circularly polarized electric waves. The antenna device 30 comprises, for example, a circularly polarized antenna unit 31, a feeder circuit board 32, a feeder circuit (not shown), and a shield case 33. The circularly polarized antenna unit 31 comprises a rectangular parallelepiped dielectric base 35 and a circular radiation electrode 36.

More specifically, as shown in FIG. 9, the circularly polarized antenna unit 31 is constructed by forming the circular radiation electrode 36 onto the top surface of the rectangular parallelepiped dielectric base 35. With the bottom surface of the dielectric base 35 serving as a mounting surface, the circularly polarized antenna unit 31 is disposed on the top surface of the feeder circuit board 32. The feeder circuit for supplying electrical power to the radiation electrode 36 is formed on the bottom surface of the feeder circuit board 32. A plurality of feeder pins 37 which connect the feeder circuit and the radiation electrode 36 so that they are in electrical conduction are disposed so as to pass through the feeder circuit board 32 and the dielectric base 35. The shield case 33 for shielding the feeder circuit through a gap is provided on the bottom surface side of the feeder circuit board 32.

In the circularly polarized antenna device 30, electrical power is directly supplied to the radiation electrode 36 from the feeder circuit through the feeder pins 37. The supplying of electrical power excites the radiation electrode 36 in order to transmit and receive circularly polarized electric waves.

As described above, in the circularly polarized antenna device 30 having the structure shown in FIG. 9, the circularly polarized antenna unit 31 is disposed on the top surface of the feeder circuit board 32, and the shield case 33 which covers the feeder circuit through a gap is disposed on the bottom surface of the feeder circuit board 32. Therefore, the circularly polarized antenna device 30 is bulky. Consequently, although, in recent years, there has been a demand for small/thinner circularly polarized antenna devices, it has been difficult to meet this demand.

In addition, since, in the circularly polarized antenna device 30, the feeder pins 37 are disposed near the center of the dielectric base 35, it is difficult to carry out an aligning operation for properly connecting the feeder pins 37 and the feeder circuit on the bottom surface of the feeder circuit board 32 so that they are in electrical conduction. Further, since, in the circularly polarized antenna device 30, the feeder pins 37 are disposed near the center of the feeder circuit board 32, the output portion of the feeder circuit must be provided at the center portion thereof. A feeder circuit which has its output section at the center portion thereof is not easy to design, making it difficult to perform feeder circuit patterning.

SUMMARY OF THE INVENTION

The present invention has been achieved to overcome the above-described problems, and has as its object the provision of a circularly polarized antenna device which can be easily designed and produced, and which can be made smaller/thinner more easily. In addition, the present invention has as its object the provision of a radio communication apparatus using the circularly polarized antenna device.

To these ends, the present invention provides the following structures to overcome the above-described problems. More specifically, according to one aspect of the present invention, there is provided a circularly polarized antenna device comprising a circularly polarized antenna unit having a radiation electrode on a top surface of a substantially circular cylindrical dielectric base. The radiation electrode is used for transmitting and receiving a circularly polarized electric wave. The circularly polarized antenna unit is mounted to a top surface of a feeder circuit board with a bottom surface of the dielectric base serving as a mounting surface. In the antenna device, a recess is formed in the bottom surface of the dielectric base of the circularly polarized antenna unit. In addition, a feeder circuit for supplying electrical power to the radiation electrode is formed on an area of the top surface of the feeder circuit board covered by the recess of the dielectric base. Further, a shield for the feeder circuit is provided inside the recess of the dielectric base. Still further, a feeder electrode which connects to the feeder circuit so as to be in electrical connection therewith is formed on an outer peripheral side surface of the dielectric base so as to be separated from the radiation electrode. Still further, electrical power output from the feeder circuit is supplied to the radiation electrode through the feeder electrode by capacitive coupling.

Although not exclusive, a feeder wiring pattern for connecting the feeder circuit and the feeder electrode of the circularly polarized antenna unit so that the feeder circuit and the feeder electrode are in electrical conduction may be formed on the top surface of the feeder circuit board. In addition, a non-grounded area and a grounded area may be formed on the bottom surface of the dielectric base of the circularly polarized antenna unit. Further, an area of the bottom surface of the dielectric base with which the feeder wiring pattern is in contact may be defined as the non-grounded area, and a grounded electrode may be formed on an area of the bottom surface of the dielectric base excluding the non-grounded area.

When either one of the above-described structures is used, a feeder wiring pattern for connecting the feeder circuit and the feeder electrode of the circularly polarized antenna unit so that the feeder circuit and the feeder electrode of the circularly polarized antenna unit are in electrical conduction may be formed on the top surface of the feeder circuit board, and a groove may be formed in the bottom surface of the dielectric base of the circularly polarized antenna unit so that at least part of the feeder wiring pattern formed on the top surface of the feeder circuit board is covered through a gap.

When any one of the above-described structures is used, the dielectric base may be formed of a dielectric material having a dielectric constant which is smaller than the dielectric constant of the feeder circuit board.

According to another aspect of the present invention, there is provided a radio communication apparatus comprising any one of the circularly polarized antenna devices having the above-described structures.

In each of the above-described structures of the invention, a recess is formed in the bottom surface of the dielectric base of the circularly polarized antenna unit, the feeder circuit is formed on the area of the top surface of the feeder circuit board covered by the recess of the dielectric base, and a shield for the feeder circuit is formed inside the recess. In other words, in each of the above-described structures, the feeder circuit and the shields are accommodated inside the recess of the dielectric base. Therefore, the feeder circuit and the shield do not have to be provided on the bottom surface of the feeder circuit board, making it possible to correspondingly make the circularly polarized antenna device thinner.

In addition, in each of the structures of the present invention, the feeder electrode is formed on the outer peripheral side surface of the dielectric base of the circularly polarized antenna unit so as to be separated from the radiation electrode, and the electrical power output from the feeder circuit is supplied to the radiation electrode from the feeder electrode by capacitive coupling. In this way, the feeder electrode is formed on the outer peripheral side surface of the dielectric base, and the feeder circuit is formed on the area of the top surface of the feeder circuit board covered by the recess of the dielectric base as described above. Therefore, it is easier to connect the feeder electrode and the feeder circuit so that they are in electrical conduction, making it possible to prevent the occurrence of problems such as connection failures. Further, the output section of the feeder circuit is located at an end portion of the circuit. Such a feeder circuit is easy to design, thereby making it possible to perform feeder circuit patterning easily.

BRIEF DESCRIPTION OF THE DRAWING(S)

FIGS. 1(*a*) to 1(*c*) illustrate a first embodiment of a circularly polarized antenna device in accordance with the present invention.

FIG. 2 illustrates an example of a feeder circuit which is provided in the circularly polarized antenna device shown in FIG. 1.

FIGS. 3(*a*) to 3(*c*) illustrate a second embodiment of a circularly polarized antenna device in accordance with the present invention.

FIG. 4 is a graph showing an example of a relationship between the ratio of a dielectric constant $\epsilon r1$ of a dielectric base to a dielectric constant $\epsilon r2$ of a feeder circuit board and a feeder wiring pattern passing loss.

FIGS. 5(*a*) and 5(*b*) illustrate a fourth embodiment of a circularly polarized antenna device in accordance with the present invention.

Figure 8A:
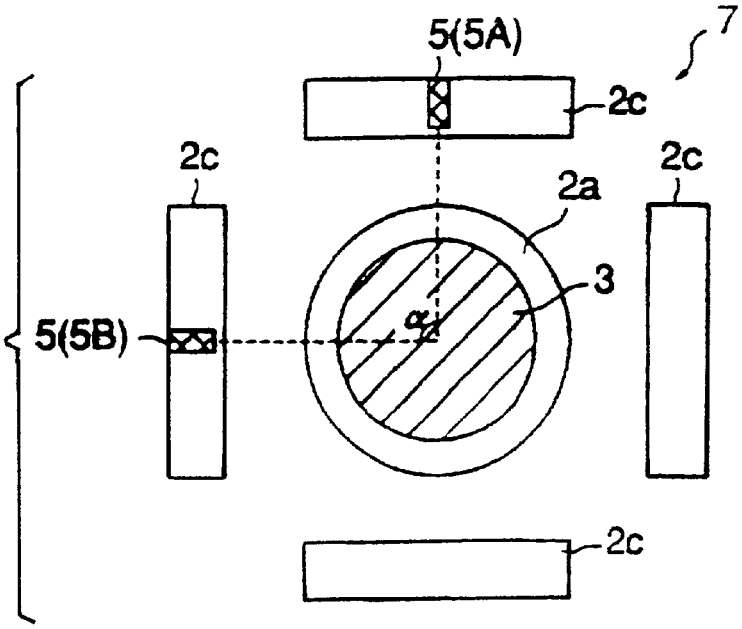
Figure 8B:
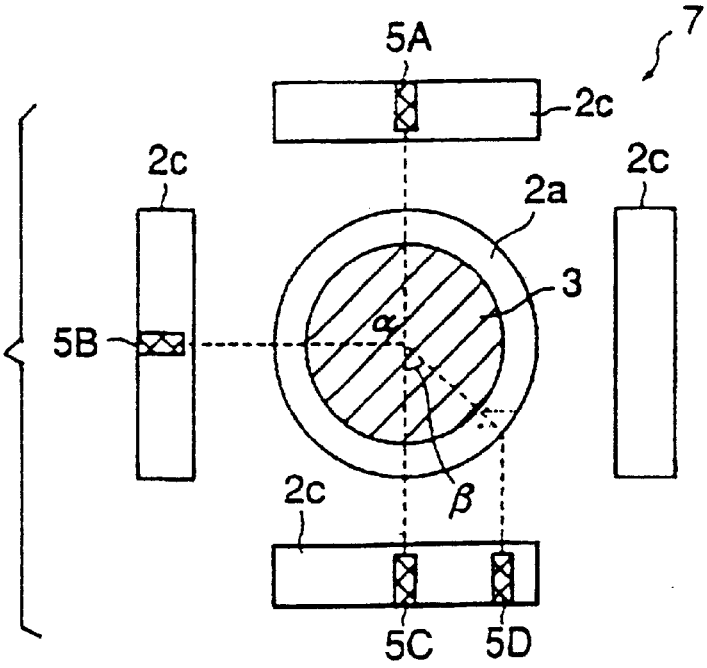

FIGS. 8(*a*) and 8(*b*) each illustrate still another embodiment of a circularly polarized antenna device in accordance with the present invention.

Figure 9:
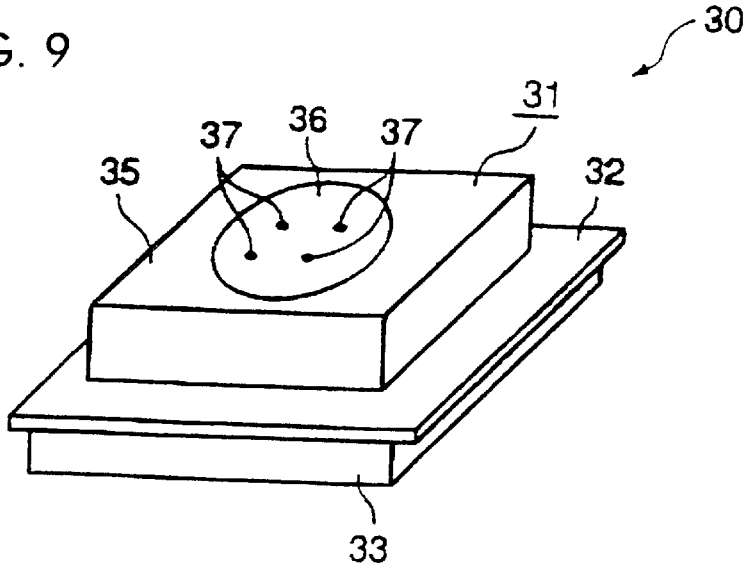

FIG. 9 illustrates an example of a conventional circularly polarized antenna device.

DETAILED DESCRIPTION OF EMBODIMENTS OF THE INVENTION

Hereunder, a description of preferred embodiments of the present invention will be given with reference to the drawings.

Figure 1A:
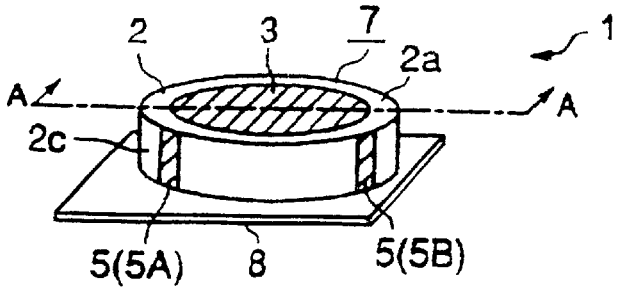
Figure 1B:
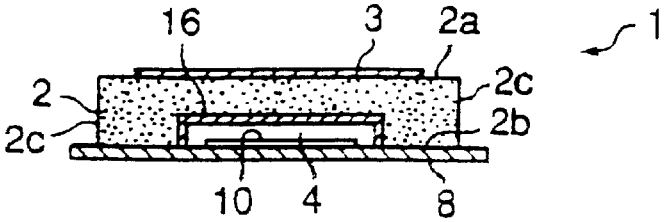
Figure 1C:
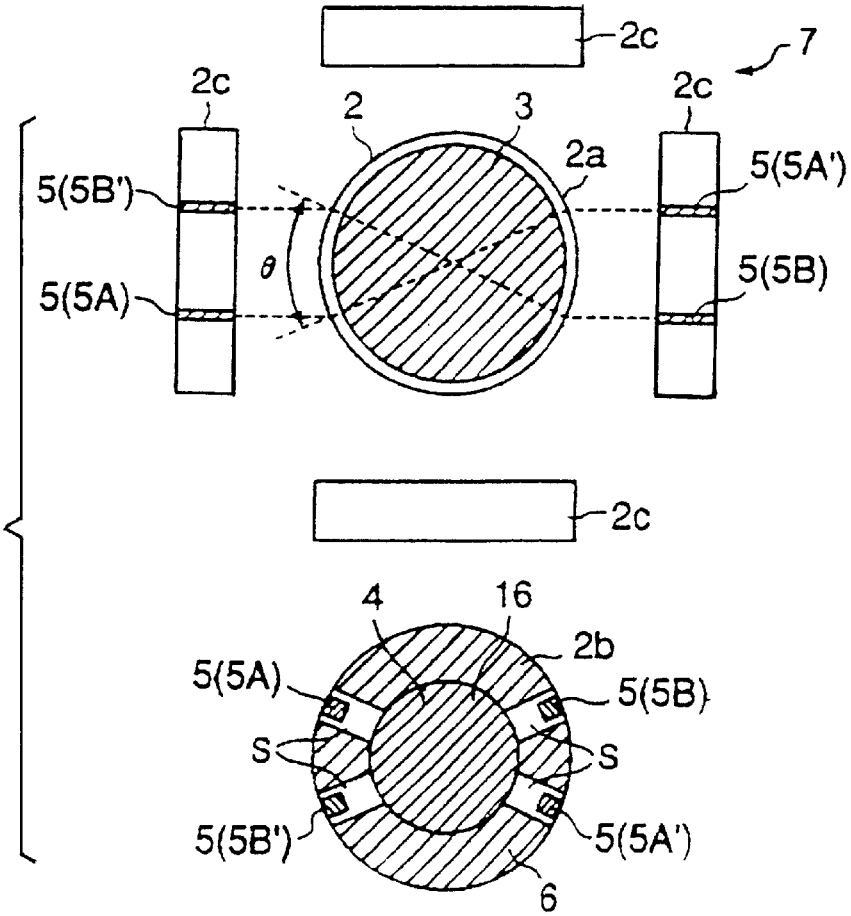

FIG. 1(*a*) is a perspective view schematically illustrating a first embodiment of a circularly polarized antenna device in accordance with the present invention. FIG. 1(*b*) is a sectional view of the circularly polarized antenna device taken along line A—A of FIG. 1(*a*). FIG. 1(*c*) is a development of a circularly polarized antenna unit of the circularly polarized antenna device shown in FIG. 1(*a*).

A circularly polarized antenna device 1 of the first embodiment of the present invention is used in, for example, a DAB system in order to transmit and receive circularly polarized waves. As shown in FIGS. 1(*a*) to 1(*c*), in the circularly polarized antenna device 1, a circular cylindrical dielectric base 2 is mounted to the top surface of a feeder circuit board 8.

The dielectric base 2 is formed of a dielectric material such as ceramic. A circular radiation electrode 3 is disposed on a top surface 2*a* of the dielectric base 2 so that its center is positioned on the center axis of the dielectric base 2. A recess 4 is formed in a bottom surface 2*b* of the dielectric base 2. The recess 4 has a form obtained by e.g., removing a portion of the dielectric base 2 so as to form a circular cylindrical shape which is similar to the external shape of the dielectric base 2. The center axis of the recess 4 is formed so as to be substantially aligned with the center axis of the dielectric base 2.

Feeder electrodes 5 (5A, 5A', 5B, and 5B') are formed on an outer peripheral side surface 2*c* of the dielectric base 2 so as to be separated from the radiation electrode 3. In the embodiment shown in FIG. 1, the feeder electrodes 5A and 5A' are disposed so as to oppose each other through the center axis of the dielectric base 2. In the same way, the feeder electrodes 5B and 5B' are disposed so as to oppose each other through the center axis of the dielectric base 2. A line through the feeder electrodes 5A (5A') and the center axis of the dielectric base 2, and a line through the feeder electrodes 5B' (5B) and the center axis of the dielectric base 2 are separated by an angle θ of approximately 45°.

A grounded electrode 6 is formed on the portion of the bottom surface 2*b* of the dielectric base 2 excluding non-grounded areas S. End portions of the feeder electrodes 5 (5A, 5A', 5B, and 5B') are formed so as to extend around their corresponding non-grounded areas S from the outer peripheral side surface 2*c* of the dielectric base 2.

In the first embodiment, the dielectric base 2, the radiation electrode 3, the feeder electrodes 5, and the grounded electrode 6 form the circularly polarized antenna unit 7.

With the bottom surface 2*b* of the dielectric base 2 serving as a mounting surface, the circularly polarized antenna unit 7 is mounted to the top surface of the feeder circuit board 8. The feeder circuit board 8 is formed of, for example, ceramic. A feeder circuit 10 is formed on the area of the top surface of the feeder circuit board 8 covered by the recess 4 of the dielectric base 2. The feeder circuit 10 is used to supply electrical power to each of the feeder electrodes 5, and has a structure such as that shown in FIG. 2. Feeder wiring patterns 11 are formed on the top surface of the feeder circuit board 8 in order to connect the feeder circuit 10 and the feeder electrodes 5 so that they are in electrical conduction. The areas of the bottom surface of the dielectric base 2 with which the feeder wiring patterns 11 are in contact form the aforementioned non-grounded areas S.

Figure 2:
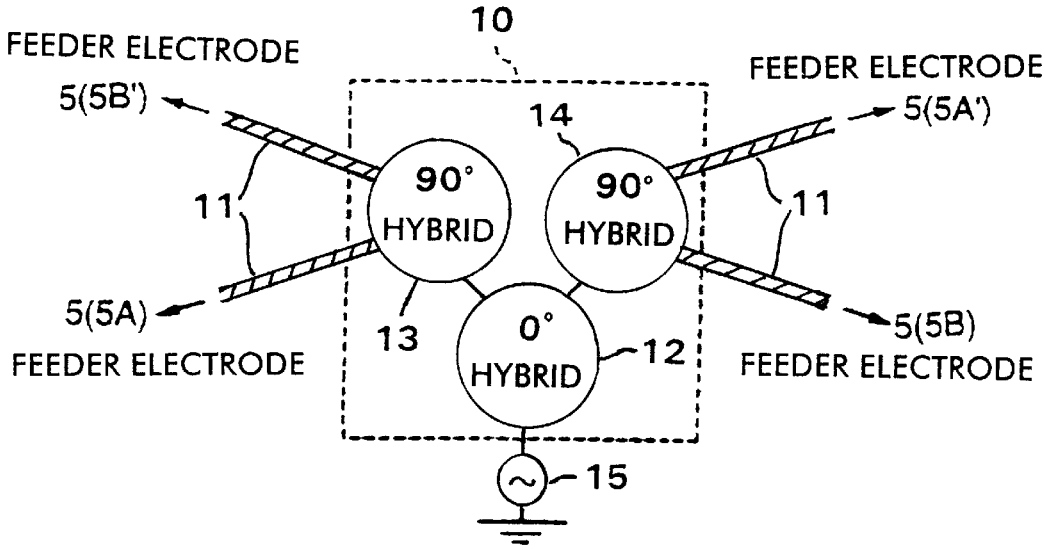

The feeder circuit 10 shown in FIG. 2 comprises a 0° hybrid 12 and 90° hybrids 13 and 14. In this feeder circuit 10, when electrical power is supplied from an electrical power supply 15, the 0° hybrid 12 divides the supplied electrical power into two portions without changing the phase of the supplied electrical power. These two electrical power portions are then supplied to the 90° hybrids 13 and 14, respectively. In each of the 90° hybrids 13 and 14, the corresponding supplied electrical power portion is divided in order to form two signals which are 90 out of phase with respect to each other. These signals are supplied to the feeder electrodes 5 through their corresponding feeder wiring patterns 11. The electrical power signals supplied to the pair of feeder electrodes 5A and 5A', and the pair of feeder electrodes 5B and 5B' are of the same phase. In contrast, the electrical power signals which are supplied to the feeder electrodes 5A and 5B (and the feeder electrodes 5A' and 5B') are 90° out of phase.

As shown in FIG. 1, a shielding film 16 that shields the feeder circuit 10 is formed along the entire inner peripheral surface defining the recess 4 of the dielectric base 2 by a film deposition technology such as plating.

A grounded electrode (not shown) is provided on the top surface of the feeder circuit board 8 in such a way as to surround the feeder circuit 10 and the feeder wiring patterns 11 with a separation between it and the feeder circuit 10 and the feeder wiring patterns 11. The grounded electrode formed on the top surface of the feeder circuit board 8 is joined to the grounded electrode 6 formed on the bottom surface of the dielectric base 2 so as to be in electrical conduction therewith, and shields, along with the shielding film 16, the feeder circuit 10 and the feeder wiring patterns 11.

The circularly polarized antenna device 1 of the first embodiment is constructed as described above. When electrical power is supplied to each of the feeder electrodes 5 from the feeder circuit 10 through the feeder wiring patterns 11, the electrical power is supplied to the radiation electrode 3 from each of the feeder electrodes 5 by capacitive coupling. The supplying of electrical power causes the radiation electrode 3 to resonate. In the first embodiment, the angle between the direction from the feeder electrode 5A (5A') to the center axis of the dielectric base 2 and the direction from the feeder electrode 5B' (5B) to the center axis of the dielectric base 2 is approximately 45°. Therefore, the radiation electrode 3 resonates in one of a plurality of previously set resonance modes, that is, a resonance mode in which the resonance frequency is high (a high mode). This causes the radiation electrode to transmit and receive high-mode circularly polarized electric waves.

In the first embodiment, as described above, the recess 4 is formed in the bottom surface of the dielectric base 2, and the feeder circuit 10 is formed on the area of the top surface of the feeder circuit board 8 covered by the recess 4 of the dielectric base 2. In addition, the shielding film 16 is disposed inside the recess 4. In other words, the feeder circuit 10 and the shield (that is, the shielding film 16) are accommodated inside the recess 4 of the dielectric base 2.

Conventionally, as shown in FIG. 9, the circularly polarized antenna unit 31 is mounted to the top surface of the feeder circuit board 32, and the feeder circuit and the shield (that is, the shield case 33) are formed on the bottom surface of the feeder circuit board 32. Therefore, the circularly polarized antenna device 30 is bulky. In contrast, in the first embodiment, as described above, the feeder circuit 10 and the shield (that is, the shield case 16) are accommodated inside the recess 4 of the dielectric base 2. This makes it unnecessary to form the feeder circuit 10 and the shield on the bottom surface of the feeder circuit board 8, thereby making it possible to correspondingly make the circularly polarized antenna device 1 considerably thinner (that is, smaller).

In the first embodiment, the antenna device 1 is constructed so that electrical power is supplied to the radiation electrode 3 from the feeder electrodes 5 by capacitive coupling, and so that the feeder electrodes 5 are formed on the outer peripheral side surface 2*c* of the dielectric base 2. Therefore, it is possible to dispose the output section of the feeder circuit 10 at an end portion thereof. Since such a circuit is easy to construct, patterning of the feeder circuit 10 can be easily carried out.

In addition, as described above, the feeder electrodes 5 are formed on the outer peripheral side surface 2*c* of the dielectric base 2, and the feeder circuit 10 and the feeder wiring patterns 11 are formed on the top surface of the feeder circuit board 8. Therefore, the dielectric base 2 can be mounted to the feeder circuit board 8 by precisely aligning the feeder electrodes 5 and the feeder wiring patterns 11. Consequently, the feeder electrodes 5 and the feeder circuit 10 can be reliably connected together so that they are in electrical conduction, making it possible to prevent the occurrence of problems such as electrical conduction failures.

Hereunder, a second embodiment of a circularly polarized antenna device in accordance with the present invention will be given. The structure of the second embodiment of the circularly polarized antenna device is virtually the same as the structure of the first embodiment of the circularly polarized antenna device. The characteristic difference from the first embodiment of the circularly polarized antenna device is that the second embodiment of the antenna device comprises a shield which is of a different form from the shielding film 16. In the description of the second embodiment, corresponding structural parts to those of the first embodiment are given the same reference numerals, and the descriptions of common parts which overlap will not be given below.

Figure 3A:
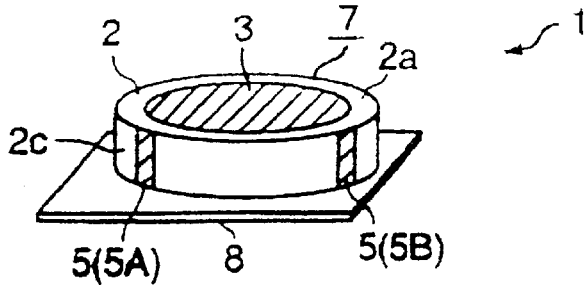
Figure 3B:
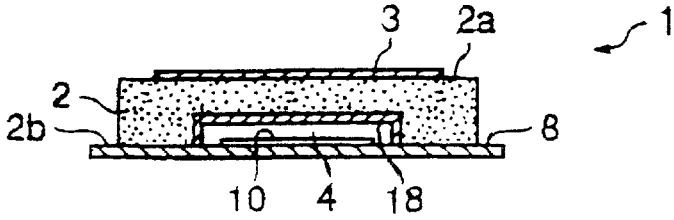
Figure 3C:
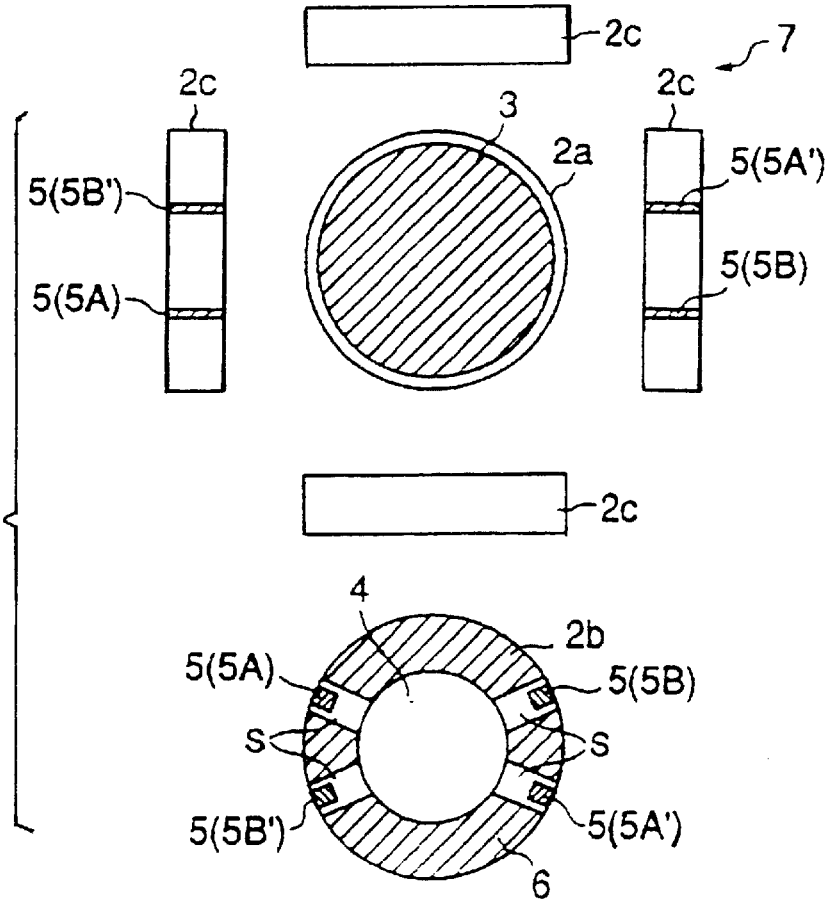

In the second embodiment, as shown in FIG. 3, in place of the shielding film 16 used in the first embodiment, a shield case 18 formed of a metallic plate material is disposed inside a recess 4 of a dielectric base 2 so as to cover a feeder circuit 10, whereby the feeder circuit 10 is shielded.

As in the first embodiment, in the second embodiment, the feeder circuit 10 and the shield case 18 serving as a shield for the feeder circuit 10 are accommodated inside the recess 4 of the dielectric base 2. Therefore, the feeder circuit 10 and the shield case 18 do not need to be provided on the back surface of a feeder circuit board 8, making it possible to prevent a circularly polarized antenna device 1 from becoming bulky correspondingly. Consequently, the circularly polarized antenna device 1 can easily be made thinner.

In addition, the antenna device 1 is constructed so that electrical power is supplied to a radiation electrode 3 from feeder electrodes 5 by capacitive coupling, and so that the feeder electrodes 5 are formed on an outer peripheral side surface 2*c* of the dielectric base 2. Therefore, as discussed in the first embodiment, the second embodiment makes it possible to provide the advantages of preventing the occurrence of the problem that an electrical conduction failure occurs between the feeder circuit 10 and the feeder electrodes 5, and of facilitating patterning of the feeder circuit 10.

Although, in the second embodiment, the shield case 18 is provided instead of the shielding film 16 used in the first embodiment, the shielding film 16 may be provided along with the shield case 18.

Hereunder, a description of a third embodiment of a circularly polarized antenna device in accordance with the present invention will be given. The characteristic of the third embodiment is that a dielectric base 2 is formed of a dielectric material having a dielectric constant $\epsilon r1$ which is smaller than a dielectric constant $\epsilon r2$ of a feeder circuit board 8. The other structural features are the same as those of the first and second embodiments. In the description of the third embodiment, corresponding structural parts to those of the first and second embodiments are given the same reference numerals, and the descriptions of common parts which overlap will not be given below.

Feeder wiring patterns 11 which connect feeder electrodes 5 and a feeder circuit 10 so that they are in electrical conduction are joined to and formed on the top side of the feeder circuit board 8, and a dielectric base 2 is placed on the top sides of the feeder wiring patterns 11. Therefore, electrical characteristics such as passing loss of the feeder wiring patterns 11 are affected by the dielectric base 2 and the feeder circuit board 8.

In the producing process, after the feeder wiring patterns 11 have been formed on the top surface of the feeder circuit board 8 by a film deposition technology, the dielectric base 2 is placed on the top sides thereof. Therefore, even if the feeder wiring patterns 11 have the required good electrical characteristics at the stage when only the feeder wiring patterns 1 have been formed on the top surface of the feeder circuit board 8 by film deposition, when, after this stage, the dielectric base 2 is placed onto the top sides of the feeder wiring patterns 11 and comes into contact therewith, they are affected by the dielectric base 2, thereby causing the electrical characteristics of the feeder wiring patterns 11 to change. This may give rise to the problem that the electrical characteristics of the feeder wiring patterns 11 change undesirably.

One may think of forming the feeder wiring patterns 11 on the top surface of the feeder circuit board 8, taking into consideration such changes in the electrical characteristics of the feeder wiring patterns 11 which occur due to the effects of the dielectric base 2. However, since the state of contact between the feeder wiring patterns 11 and the dielectric base 2 differ with different devices, the changes in the electrical characteristics of the feeder wiring patterns 11 which occur due to the effects of the dielectric base 2 differ because of differences in the state of contact between the feeder wiring patterns 11 and the dielectric base 2. Therefore, it is difficult for the feeder wiring patterns 11 to have the required good electrical characteristics. In addition, there is the problem that the electrical characteristics of the feeder wiring patterns 11 vary with different devices.

Figure 4:
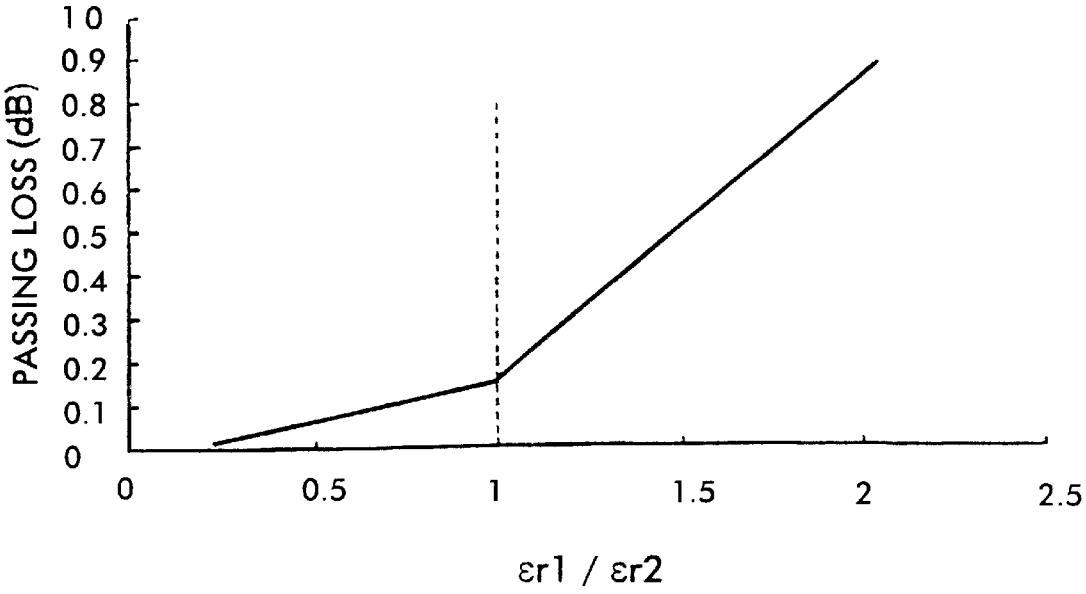

The present inventor has turned his attention to the fact that, when the dielectric constant $\epsilon r1$ of the dielectric base 2 which is placed on the top sides of the feeder wiring patterns 11 on the feeder circuit board 8 is equal to or greater than the dielectric constant $\epsilon r2$ of the feeder circuit board 8, the electrical characteristics of the feeder wiring patterns 11 are greatly affected by the dielectric base 2. The results of the experiment (discussed next) which has been conducted by the inventor are shown in FIG. 4. In the experiment, an examination was made as to how the passing loss of the feeder wiring patterns 11 after placing the dielectric base 2 on the top sides of the feeder wiring patterns 11 on the feeder circuit board 8 increases with respect to the passing loss of the feeder wiring patterns 11 before placing the dielectric base 2 thereon due to changes in the ratio between the dielectric constant $\epsilon r1$ of the dielectric base 2 and the dielectric constant $\epsilon r2$ of the feeder circuit board 8 (that is, dielectric constant $\epsilon r1$/dielectric constant $\epsilon r2$).

As illustrated by the experimental results shown in FIG. 4, when the dielectric ratio (dielectric constant $\epsilon r1$/dielectric constant $\epsilon r2$) is less than 1, that is, when the dielectric constant $\epsilon r1$ of the dielectric base 2 is less than the dielectric constant $\epsilon r2$ of the feeder circuit board 8, the increase in the passing loss of the feeder wiring patterns 11 after placing the dielectric base 2 onto the feeder wiring patterns 11 with respect to that before placing the dielectric base 2 thereon is made small. In contrast, when the dielectric ratio (dielectric constant $\epsilon r1$/dielectric constant $\epsilon r2$) is equal to or greater than 1, that is, when the dielectric constant $\epsilon r1$ of the dielectric base 2 is equal to or greater than the dielectric constant $\epsilon r2$ of the feeder circuit board 8, the increase in the passing loss of the feeder wiring patterns 11 after placing the dielectric base 2 on the feeder wiring patterns 11 with respect to that before placing the dielectric base 2 thereon becomes larger. Therefore, in this case, it can be understood that the required good electrical characteristics of the feeder wiring patterns 11 are difficult to obtain.

Accordingly, in the structure of the third embodiment, as discussed above, the dielectric base 2 is formed of a dielectric material having a dielectric constant $\epsilon r1$ which is less than the dielectric constant $\epsilon r2$ of the feeder circuit board 8 in order to decrease the effects of the dielectric base 2 on the feeder wiring patterns 11, thereby making it easier for the feeder wiring patterns 11 to have good electrical characteristics.

In other words, it is possible to design the feeder wiring patterns 11 almost without considering the changes in the electrical characteristics occurring after the placement of the dielectric base 2 on the feeder wiring patterns 11, thereby facilitating the designing of the feeder wiring patterns 11. In addition to this, the feeder wiring patterns 11 can be easily formed as designed on the top surface of the feeder circuit board 8 so that good electrical characteristics are obtained. Further, even if the dielectric base 2 is placed on the top side of the feeder wiring patterns 11 formed on the top surface of the feeder circuit board 8 so that good electrical characteristics are obtained, the feeder wiring patterns 11 keep possessing good electrical characteristics with almost no changes in the electrical characteristics. Therefore, it is easier for the feeder wiring patterns 11 to have good electrical characteristics, and the problem that electrical characteristics of the feeder wiring patterns 11 vary can be prevented from occurring.

Figure 5A:
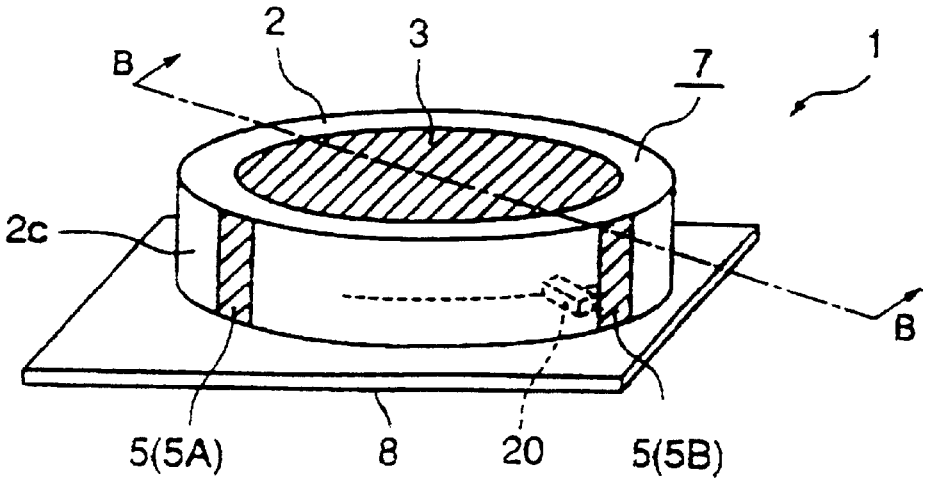
Figure 5B:
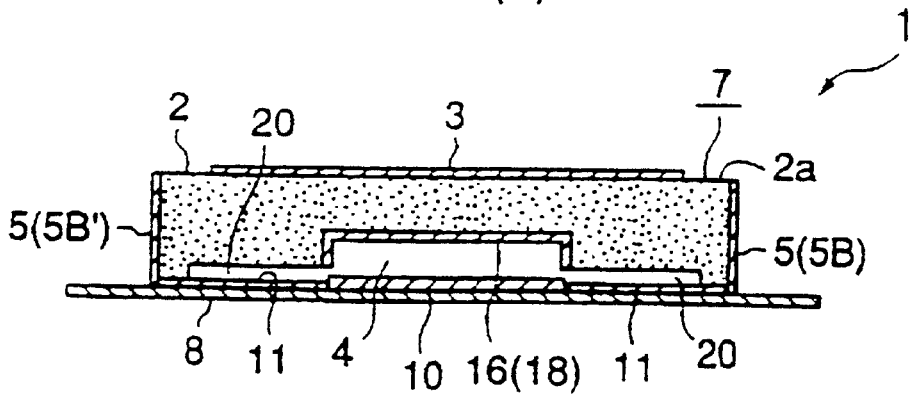

Hereunder, a description of a fourth embodiment of a circularly polarized antenna device in accordance with the present invention will be given. FIG. 5(*a*) is a perspective view of a fourth embodiment of a circularly polarized antenna device 1 in accordance with the present invention. FIG. 5(*b*) is a sectional view taken along line B—B of FIG. 5(*a*). In the description of the fourth embodiment, corresponding structural parts to those of the first to third embodiments are given the same reference numerals.

The characteristic of the fourth embodiment is that, as shown in FIGS. 5(*a*) and 5(*b*), a groove 20 is formed in the bottom surface of a dielectric base 2 so that part of each feeder wiring pattern 11 is covered through a gap. The other structural features are the same as those of the first to third embodiments, and the descriptions of common parts which overlap are not given below.

In the fourth embodiment shown in FIG. 5(*b*), a shielding film 16 is not formed on the inner peripheral surface defining the groove 20. However, a shielding film may be formed on the inner peripheral surface defining the groove 20 as required.

In the fourth embodiment, the groove 20 is formed in the bottom surface of the dielectric base 2 so that part of each feeder wiring pattern 1 is covered through a gap, thereby making it possible to make the dielectric base 2 lighter.

The gap is formed above part of each feeder wiring pattern 11. Since the dielectric constant of the gap (air) is considerably smaller than a dielectric constant $\epsilon r2$ of a feeder circuit board 8, the electrical characteristics of the feeder wiring patterns 11 are only affected by the feeder circuit board 8 because they are almost not affected by the gap. Therefore, it becomes easier to design the feeder wiring patterns 11, and it is possible for the feeder wiring patterns 11 to have good electrical characteristics.

Figure 6:
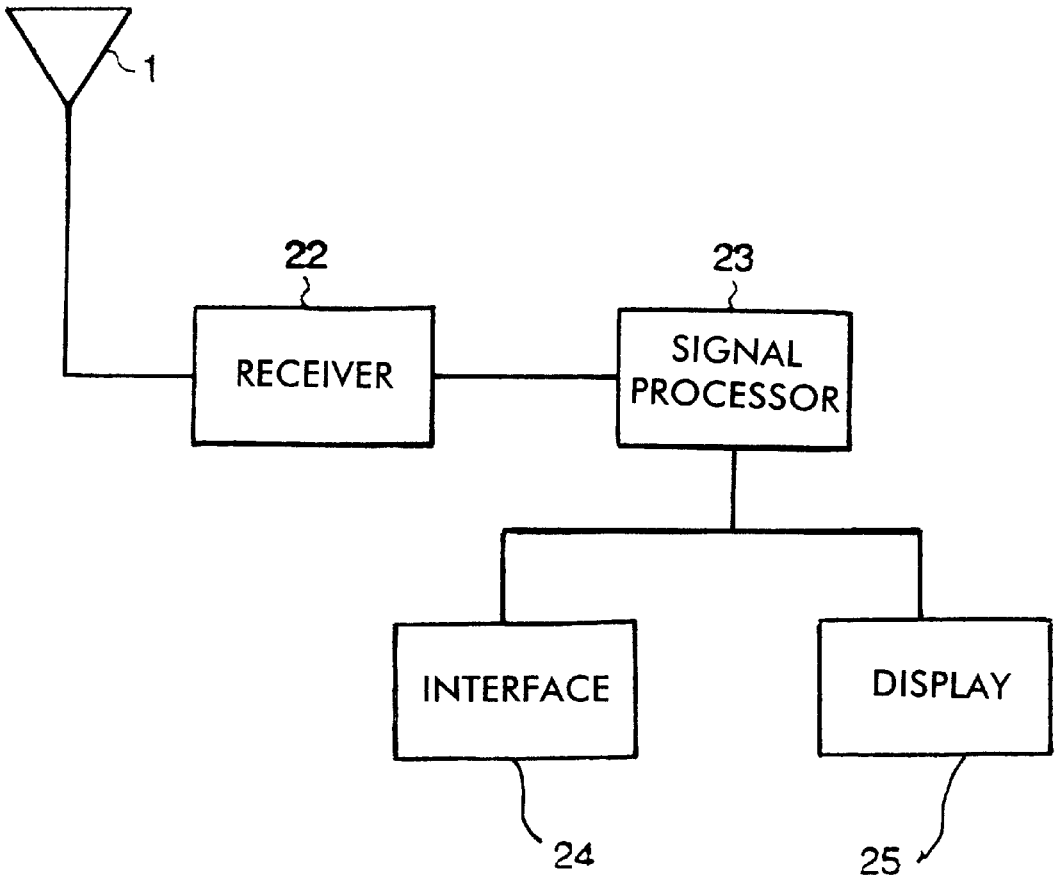
FIG. 6 is a block diagram of the structure of a radio communication apparatus in accordance with the present invention.

Hereunder, a description of an embodiment of a radio communication apparatus of the present invention will be given. FIG. 6 is a block diagram of an example of a main structure of the embodiment of the radio communication apparatus. The radio communication apparatus of the embodiment makes use of a DAB system. The characteristic of the radio communication apparatus is that it includes the circularly polarized antenna device 1 of any one of the above-described embodiments. Since the structure of each of the circularly polarized antenna device 1 has been described in the discussion regarding each of the first to fourth embodiments, a discussion thereof will not be repeated.

As shown in FIG. 6, the radio communication apparatus comprises the circularly polarized antenna device 1 of any one of the above-described embodiments, a receiver 22, a signal processor 23, an interface 24, and a display 25. In this radio communication apparatus, for example, an electrical wave signal received by the circularly polarized antenna device 1 is supplied to the receiver 22. The receiver 22 takes out various predetermined signals from the supplied electrical wave signal, and outputs them to the signal processor 23. The signal processor 23 processes the various predetermined signals it has received in accordance with a previously determined method in order to, for example, control the displaying operation of the display 25 in connection with the interface 24 such as a remote controller. Although FIG. 6 shows a receiver device, the antenna is applicable also to transmitter devices and to transmitter (receivers/transceivers).

According to the embodiment, the radio communication apparatus 1 is constructed so as to comprise the circularly polarized antenna device 1 of any one of the above-described embodiments. Therefore, the radio communication apparatus can be made small and thin.

The present invention is not limited to the above-described embodiments, so that it may be otherwise variously embodied. For example, although in each of the above-described embodiments, the dielectric base 2 has a circular cylindrical shape, it may have a substantially circular cylindrical shape. For example, the dielectric base 2 of each of the above-described embodiments may have an elliptic cylindrical shape or a polygonal cylindrical shape having, for example, 20 sides. In addition, the feeder electrode formation area in the outer peripheral side surface of the corresponding dielectric base 2 may have a flat surface, in which case it becomes easier to form the feeder electrodes 5 of any one of the above-described antenna devices 1 using a film deposition technology such as printing.

Further, although in each of the above-described embodiments, the radiation electrode 3 is circular in shape, it may be substantially circular in shape. It may have, for example, an elliptical shape or a polygonal shape having, for example, 20 sides. However, it is desirable that the separation between the outer edge of the corresponding radiation electrode and the outer edge of the contour of the corresponding dielectric base 2 be substantially the same throughout the entire circumference of the outer edge of the contour of the corresponding dielectric base 2.

Figure 7:
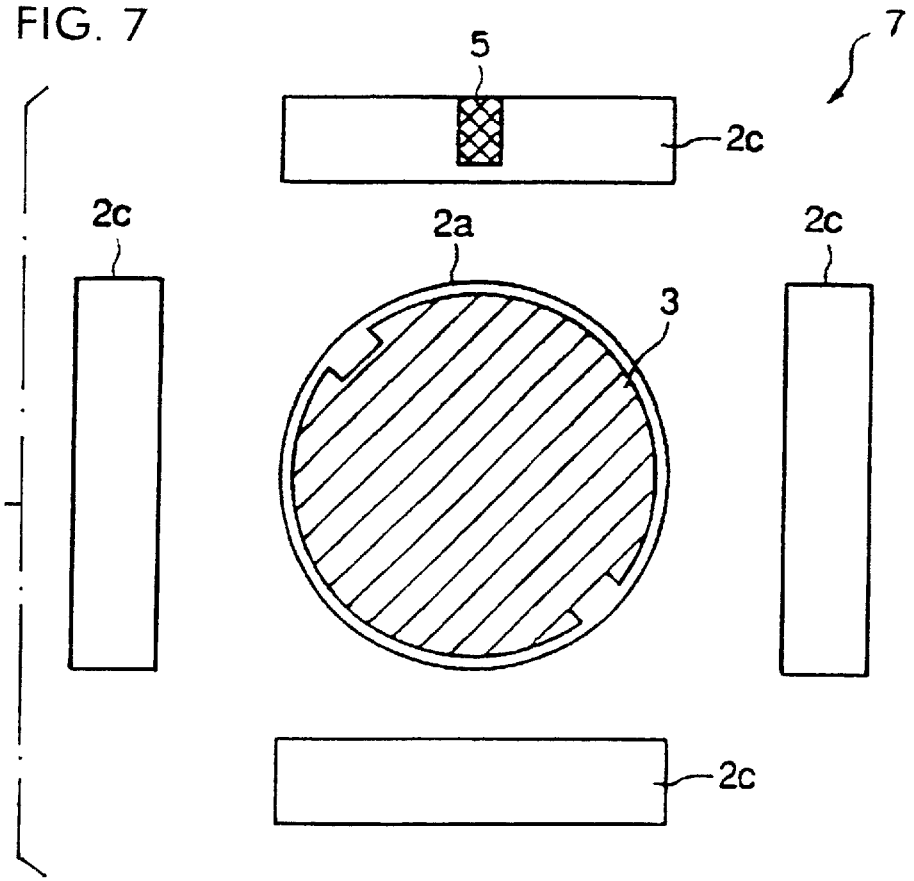
FIG. 7 illustrates another embodiment of a circularly polarized antenna device in accordance with the present invention.

Still further, although in each of the above-described embodiments the antenna device 1 is constructed so that the corresponding radiation electrode 3 is made to resonate by supplying electrical power at two points, it may, for example, be constructed so that it is made to resonate by supplying electrical power at one point, as shown in FIG. 7. In this case, as shown in FIG. 7, the corresponding radiation electrode 3 is in a form in which it is degenerated.

Still further, although the location where each of the feeder electrodes 5 used in each of the above-described embodiments is disposed is specified so that the corresponding radiation electrode 3 operates in one of the set resonance modes, that is, the high mode in which the resonance frequency is high, the location where each of the feeder electrodes 5 is disposed may be specified so that the corresponding radiation electrode 3 operates in another one of the set resonance modes such as a basic mode in which the resonance frequency is lowest. In other words, in another embodiment, as shown in FIG. 8(*a*), feeder electrodes 5A and 5B may be formed on an outer peripheral side surface 2*c* of a dielectric base 2 so that an angle a between the direction from the feeder electrode 5A to the center axis of the dielectric base 2 and the direction from the feeder electrode 5B to the center axis of the dielectric base 2 is 90°. In this case, a feeder circuit 10 and feeder wiring patterns 11 are formed so that electrical power portions which are out of phase by 90° are supplied to the feeder electrode 5A and the feeder electrode 5B, respectively. Still further, the location where each of the feeder electrodes 5 used in each of the above-described embodiments is disposed may be set so that the corresponding radiation electrode can resonate in both the basic mode and the high mode. In this case, each of the feeder electrodes 5 is disposed as shown in, for example, FIG. 8(*b*). More specifically, in another embodiment shown in FIG. 8(*b*), basic mode feeder electrodes 5A and 5B and high-mode feeder electrodes 5C and 5D are formed on an outer peripheral side surface 2*c* of a dielectric base 2. An angle $\alpha$ between the direction from the feeder electrode 5A to the center axis of the dielectric base 2 and the direction from the feeder electrode 5B to the center axis of the dielectric base 2 is 90°. An angle $\beta$ between the direction from the feeder electrode 5C to the center axis of the corresponding dielectric base 2 and the direction from the feeder electrode 5D to the center axis of the dielectric base 2 is 45°. By virtue of this structure, a radiation electrode 3 can transmit and receive circularly polarized waves of two different frequency bands. In this case, basic mode electrical power portions which are 90' out of phase are supplied to the feeder electrodes 5A and 5B, while high-mode electrical power portions which are 90° out of phase are supplied to the feeder electrodes 5C and 5D.

Still further, although in each of the above-described embodiments, the corresponding grounded electrode 6 is formed on the portion of the bottom surface 2*b* of the corresponding dielectric base 2 excluding the non-grounded areas S, the corresponding grounded electrode 6 does not need to be formed on the bottom surface of the corresponding dielectric base 2 when the bottom surface of the corresponding dielectric base 2 can be joined in very close contact to the corresponding grounded electrode on the top surface of the corresponding feeder circuit board 8.

Still further, although in the fourth embodiment the groove 20 formed in the bottom surface of the dielectric base 2 is connected to the recess 4, all that is necessary is for the groove 20 to be formed so that part of each of the feeder wiring patterns 11 is covered through a gap. Therefore, it does not need to be connected to the recess 4. Still further, although in the fourth embodiment the groove 20 is of a form which allows part of each of the feeder wiring patterns 11 to be covered through a gap, it may take other forms. For example, a groove 20 which extends from the recess 4 in the dielectric base 2 so as to pass through the outer peripheral surface of the dielectric base 2 along the feeder wiring patterns 11 may be formed in order to form the groove 20 into a form which allows the entire feeder wiring patterns 11 to be covered through a gap by the groove 20. In this case, a specific step is taken to connect the feeder electrode 5 and the feeder wiring patterns 11 so that they are in electrical conduction.

Still further, although in the embodiment of the radio communication apparatus the circularly polarized antenna device 1 of any one of the first to fourth embodiments is described as being installed in a radio communication apparatus which makes use of a system such as DAB, the circularly polarized antenna device 1 of any one of the first to fourth embodiments may be installed in a radio communication apparatus which makes use of a system other than the DAB system.

According to the present invention, a recess is formed in the bottom surface of the dielectric base, and the feeder circuit is formed on an area of the top surface of the feeder circuit board covered by the recess. In addition, the shield for the feeder circuit is provided inside the recess, that is, the feeder circuit and the shield are accommodated inside the recess of the dielectric base. Therefore, the feeder circuit and the shield are not provided on the bottom surface of the feeder circuit board, making it possible to correspondingly restrict the bulkiness of the circularly polarized antenna device, so that the circularly polarized antenna device can be made thinner.

The circularly polarized antenna device is constructed so that electrical power is supplied to the radiation electrode from the feeder electrodes by capacitive coupling, and so that the feeder electrodes are formed on the outer peripheral side surface of the dielectric base. Therefore, it becomes easier to connect the feeder electrodes and the feeder circuit formed on the top surface of the feeder circuit board so that they are in electrical conduction, making it possible to prevent the occurrence of problems such as electrical conduction failures between the feeder electrodes and the feeder circuit. In addition, since the output section of the feeder circuit can be formed at an end of the circuit, it becomes easier to perform feeder circuit patterning.

In the case where the area of the bottom surface of the dielectric base with which the feeder wiring pattern which connects the feeder circuit and the feeder electrodes so that they are in electrical conduction is in contact is a non-grounded area, and the grounded electrode is formed on the area of the bottom surface of the dielectric base excluding the non-grounded areas, the shield inside the recess can more reliably exhibit its shielding capability.

In the case where a groove is formed in the bottom surface of the dielectric base so that at least part of each of the feeder wiring patterns is covered through a gap, the dielectric base can be made lighter. The gap is formed at the side of each of the feeder wiring patterns adjacent the dielectric base. This gap has almost no adverse effects on the electrical characteristics of the feeder wiring patterns. Therefore, it is possible to obtain feeder wiring patterns having electrical characteristics substantially in accordance with the design.

In the case where the dielectric base is formed of a dielectric material having a dielectric constant which is smaller than that of the feeder circuit board, the degree with which the dielectric base affects the electrical characteristics of the feeder wiring patterns is extremely small, making it easier to obtain feeder wiring patterns having electrical characteristics substantially in accordance with the design.

In the present invention, when the radio communication apparatus incorporates a circularly polarized antenna device having any one of the above-described characteristic structures, the radio communication apparatus can be made thinner as the circularly polarized antenna device is made thinner.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A circularly polarized antenna device comprising:

a circularly polarized antenna unit including a radiation electrode on a top surface of a substantially circular cylindrical dielectric base, the radiation electrode being used for transmitting and receiving a circularly polarized electric wave, the circularly polarized antenna unit being mounted to a top surface of a feeder circuit board with a bottom surface of the dielectric base serving as a mounting surface;

wherein a recess is formed in the bottom surface of the dielectric base of the circularly polarized antenna unit;

wherein a feeder circuit for supplying electrical power to the radiation electrode is formed on an area of the top surface of the feeder circuit board covered by the recess of the dielectric base;

wherein a shield for the feeder circuit is provided inside the recess of the dielectric base;

wherein a feeder electrode which connects to the feeder circuit so as to be in electrical connection therewith is formed on an outer peripheral side surface of the dielectric base so as to be separated from the radiation electrode; and wherein electrical power output from the feeder circuit is supplied to the radiation electrode through the feeder electrode by capacitive coupling.

2. The circularly polarized antenna device according to claim 1, wherein a feeder wiring pattern for connecting the feeder circuit and the feeder electrode of the circularly polarized antenna unit so that the feeder circuit and the feeder electrode are in electrical conduction is formed on the top surface of the feeder circuit board, wherein a non-grounded area and a grounded area are formed on the bottom surface of the dielectric base of the circularly polarized antenna unit, wherein an area of the bottom surface of the dielectric base with which the feeder wiring pattern is in contact is defined as the non-grounded area, and wherein a grounded electrode is formed on an area of the bottom surface of the dielectric base excluding the non-grounded area.

3. The circularly polarized antenna device according to claim 2, wherein a feeder wiring pattern for connecting the feeder circuit and the feeder electrode of the circularly polarized antenna unit so that the feeder circuit and the feeder electrode of the circularly polarized antenna unit are in electrical conduction is formed on the top surface of the feeder circuit board, and wherein a groove is formed in the bottom surface of the dielectric base of the circularly polarized antenna unit so that at least part of the feeder wiring pattern formed on the top surface of the feeder circuit board is covered through a gap.

4. The circularly polarized antenna device according to claim 2, wherein the dielectric base comprises a dielectric material having a dielectric constant which is smaller than the dielectric constant of the feeder circuit board.

5. The circularly polarized antenna device according to claim 1, wherein a feeder wiring pattern for connecting the feeder circuit and the feeder electrode of the circularly polarized antenna unit so that the feeder circuit and the feeder electrode of the circularly polarized antenna unit are in electrical conduction is formed on the top surface of the feeder circuit board, and wherein a groove is formed in the bottom surface of the dielectric base of the circularly polarized antenna unit so that at least part of the feeder wiring pattern formed on the top surface of the feeder circuit board is covered through a gap.

6. The circularly polarized antenna device according to claim 3, wherein the dielectric base comprises a dielectric material having a dielectric constant which is smaller than the dielectric constant of the feeder circuit board.

7. The circularly polarized antenna device according to claim 1, wherein the dielectric base comprises a dielectric material having a dielectric constant which is smaller than the dielectric constant of the feeder circuit board.

8. The circularly polarized antenna device according to claim 1, wherein the dielectric base is one of circular, polygonal or elliptical in cross section.

9. A radio communication apparatus comprising at least one of a transmitter and a receiver coupled to an antenna, the antenna comprising:

a circularly polarized antenna unit including a radiation electrode on a top surface of a substantially circular cylindrical dielectric base, the radiation electrode being used for transmitting and receiving a circularly polarized electric wave, the circularly polarized antenna unit being mounted to a top surface of a feeder circuit board with a bottom surface of the dielectric base serving as a mounting surface;

wherein a recess is formed in the bottom surface of the dielectric base of the circularly polarized antenna unit;

wherein a feeder circuit for supplying electrical power to the radiation electrode is formed on an area of the top surface of the feeder circuit board covered by the recess of the dielectric base;

wherein a shield for the feeder circuit is provided inside the recess of the dielectric base;

wherein a feeder electrode which connects to the feeder circuit so as to be in electrical connection therewith is formed on an outer peripheral side surface of the dielectric base so as to be separated from the radiation electrode; and wherein electrical power output from the feeder circuit is supplied to the radiation electrode through the feeder electrode by capacitive coupling.

10. The radio communication apparatus according to claim 9, wherein a feeder wiring pattern for connecting the feeder circuit and the feeder electrode of the circularly polarized antenna unit so that the feeder circuit and the feeder electrode are in electrical conduction is formed on the top surface of the feeder circuit board, wherein a non-grounded area and a grounded area are formed on the bottom surface of the dielectric base of the circularly polarized antenna unit, wherein an area of the bottom surface of the dielectric base with which the feeder wiring pattern is in contact is defined as the non-grounded area, and wherein a grounded electrode is formed on an area of the bottom surface of the dielectric base excluding the non-grounded area.

11. The radio communication apparatus according to claim 10, wherein a feeder wiring pattern for connecting the feeder circuit and the feeder electrode of the circularly polarized antenna unit so that the feeder circuit and the feeder electrode of the circularly polarized antenna unit are in electrical conduction is formed on the top surface of the feeder circuit board, and wherein a groove is formed in the bottom surface of the dielectric base of the circularly polarized antenna unit so that at least part of the feeder wiring pattern formed on the top surface of the feeder circuit board is covered through a gap.

12. The radio communication apparatus according to claim 10, wherein the dielectric base comprises a dielectric material having a dielectric constant which is smaller than the dielectric constant of the feeder circuit board.

13. The radio communication apparatus according to claim 9, wherein a feeder wiring pattern for connecting the feeder circuit and the feeder electrode of the circularly polarized antenna unit so that the feeder circuit and the feeder electrode of the circularly polarized antenna unit are in electrical conduction is formed on the top surface of the feeder circuit board, and wherein a groove is formed in the bottom surface of the dielectric base of the circularly polarized antenna unit so that at least part of the feeder wiring pattern formed on the top surface of the feeder circuit board is covered through a gap.

14. The radio communication apparatus according to claim 11, wherein the dielectric base comprises a dielectric material having a dielectric constant which is smaller than the dielectric constant of the feeder circuit board.

15. The radio communication apparatus according to claim 9, wherein the dielectric base comprises a dielectric material having a dielectric constant which is smaller than the dielectric constant of the feeder circuit board.

16. The radio communication apparatus according to claim 9, wherein the dielectric base is one of circular, polygonal or elliptical in cross section.

* * * * *